US005638567A

United States Patent [19]

Danyluk

[11] Patent Number: 5,638,567

[45] Date of Patent: Jun. 17, 1997

[54] GOLF BALL WASHER

[76] Inventor: Joseph John Danyluk, 14232 - 103 Avenue, Edmonton, Alberta, Canada, T5N 0S8

[21] Appl. No.: 512,923

[22] Filed: Aug. 9, 1995

[51] Int. Cl.[6] ..... A63B 47/04

[52] U.S. Cl. ..... 15/21.2; 15/104.92; 15/160

[58] Field of Search ..... 15/21.2, 97.1, 15/104.92, 160, 244.1, 104.93

[56] References Cited

U.S. PATENT DOCUMENTS

| | | | |
|---|---|---|---|
| 1,747,724 | 2/1930 | Mollart | 15/21.2 |
| 1,758,011 | 5/1930 | Reach | 15/21.2 |
| 2,023,932 | 12/1935 | Meikle | 15/21.2 |
| 2,617,132 | 11/1952 | Goller | 15/21.2 |
| 2,822,558 | 2/1958 | Vandervort et al. | 15/21.2 |
| 3,063,083 | 11/1962 | Obitts | 15/104.92 |
| 3,101,497 | 8/1963 | Derkocz | 15/21.2 |
| 3,102,291 | 9/1963 | Frater | 15/21.2 |
| 3,304,659 | 2/1967 | Eichhorn | 15/21.2 |
| 3,380,095 | 4/1968 | Piper, Jr. | 15/21.2 |
| 3,583,016 | 6/1971 | McConnell | 15/21.2 |
| 3,678,526 | 7/1972 | Burkholder | 15/21.2 |
| 3,748,676 | 7/1973 | Warren et al. | 15/21.2 |
| 4,344,203 | 8/1982 | Gerrick | 15/21 A |
| 4,750,232 | 6/1988 | Doney | 15/104.92 |
| 4,945,596 | 8/1990 | Chang et al. | 15/21.2 |
| 4,965,906 | 10/1990 | Mauro | 15/21.2 |
| 5,555,586 | 9/1996 | Dorrich et al. | 15/21.2 |

FOREIGN PATENT DOCUMENTS

WO91/06347 5/1991 WIPO .

*Primary Examiner*—Gary K. Graham

[57] ABSTRACT

A golf ball washer includes a housing having interior walls defining an interior cavity and a cylindrical lip defining an access opening. The cylindrical lip has exterior threads. Abrasive ball cleaning medium lines the interior walls of the interior cavity. A plunger is disposed within the interior cavity of the housing. The plunger has a first end and a second end. The plunger is movable between an extended position and a retracted position. In the extended position the first end of the plunger telescopically extends from the access opening of the housing. In the retracted position the plunger is confined within the housing. The plunger has a golf ball receiving aperture extending therethrough. The golf ball receiving aperture protrudes from the access opening when the plunger is in the extended position, such that a golf ball can be inserted in the golf ball receiving aperture. A top cap is rotatably mounted to the first end of the plunger. The top cap has a depending annular skirt with interior threads. The interior threads on the annular skirt of the top cap mate with the exterior threads on the cylindrical lip of the housing when the top cap is rotated relative to the plunger with the plunger is in the retracted position.

6 Claims, 6 Drawing Sheets

GOLF BALL WASHER

FIELD OF THE INVENTION

The present invention relates to a golf ball washer.

BACKGROUND OF THE INVENTION

Washing a golf ball between each golf hole has become a generally accepted ritual in the game of golf. Most golf courses have a golf ball washer positioned at each tee box area. Each tee box area has a number of tee boxes, usually designated by colour to represent differing degrees of difficulty. Depending upon the colour of tee box a player uses, the distance to the golf ball washer can be considerable. The rules of golf provide that a player is unable to pick up his ball until he or she reaches the putting green. It is unusual for golf ball washers to be positioned adjacent a putting green. It would represent a tremendous convenience for the golfer to have a golf ball washer, that he could carry with him during his round of golf. Unfortunately, the structure of current golf ball washers is unsuitable for such use.

SUMMARY OF THE INVENTION

What is required is a golf ball washer suitable to be carried by the golfer during a round of golf.

According to the present invention there is provided a golf ball washer including a housing having interior walls defining an interior cavity and a cylindrical lip defining an access opening. The cylindrical lip has exterior threads. Abrasive ball cleaning medium lines the interior walls of the interior cavity. A plunger is disposed within the interior cavity of the housing. The plunger has a first end and a second end. The plunger is movable between an extended position and a retracted position. In the extended position the first end of the plunger telescopically extends from the access opening of the housing. In the retracted position the plunger is confined within the housing. The plunger has a golf ball receiving aperture extending therethrough. The golf ball receiving aperture protrudes from the access opening when the plunger is in the extended position, such that a golf ball can be inserted in the golf ball receiving aperture. A top cap is rotatably mounted to the first end of the plunger. The top cap has a depending annular skirt with interior threads. The interior threads on the annular skirt of the top cap mate with the exterior threads on the cylindrical lip of the housing when the top cap is rotated relative to the plunger when the plunger is in the retracted position.

The golf ball washer, as described above, can be constructed in a miniature form slightly larger than a 16 ounce pop can. More importantly, the golf ball washer, as described above, solves the problem of sealing a fluid containing housing while still having an operative mechanism.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
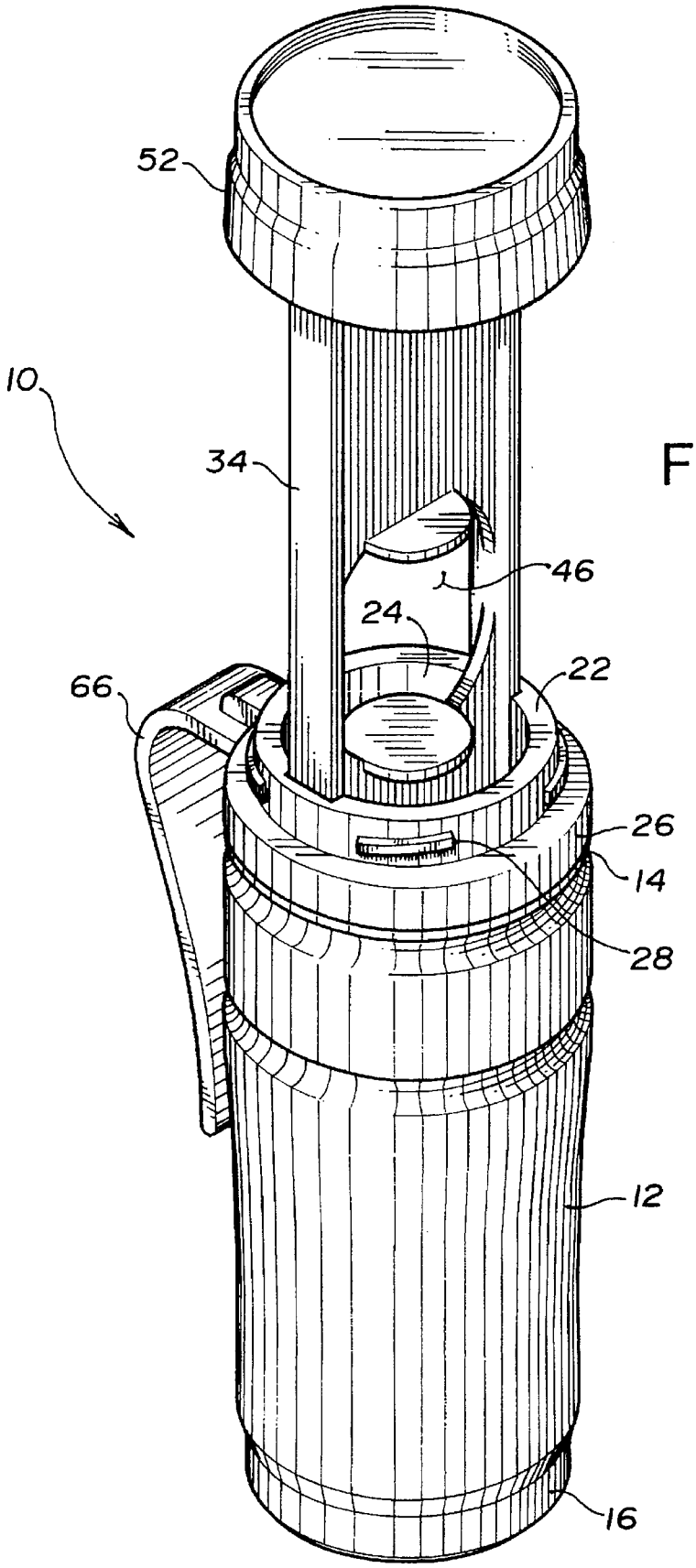
FIG. 1 is a perspective view of a golf ball washer constructed in accordance with the teachings of the present invention.

The preferred embodiment, a golf ball washer generally identified by reference numeral 10, will now be described with reference to FIGS. 1 through 8.

Figure 2:
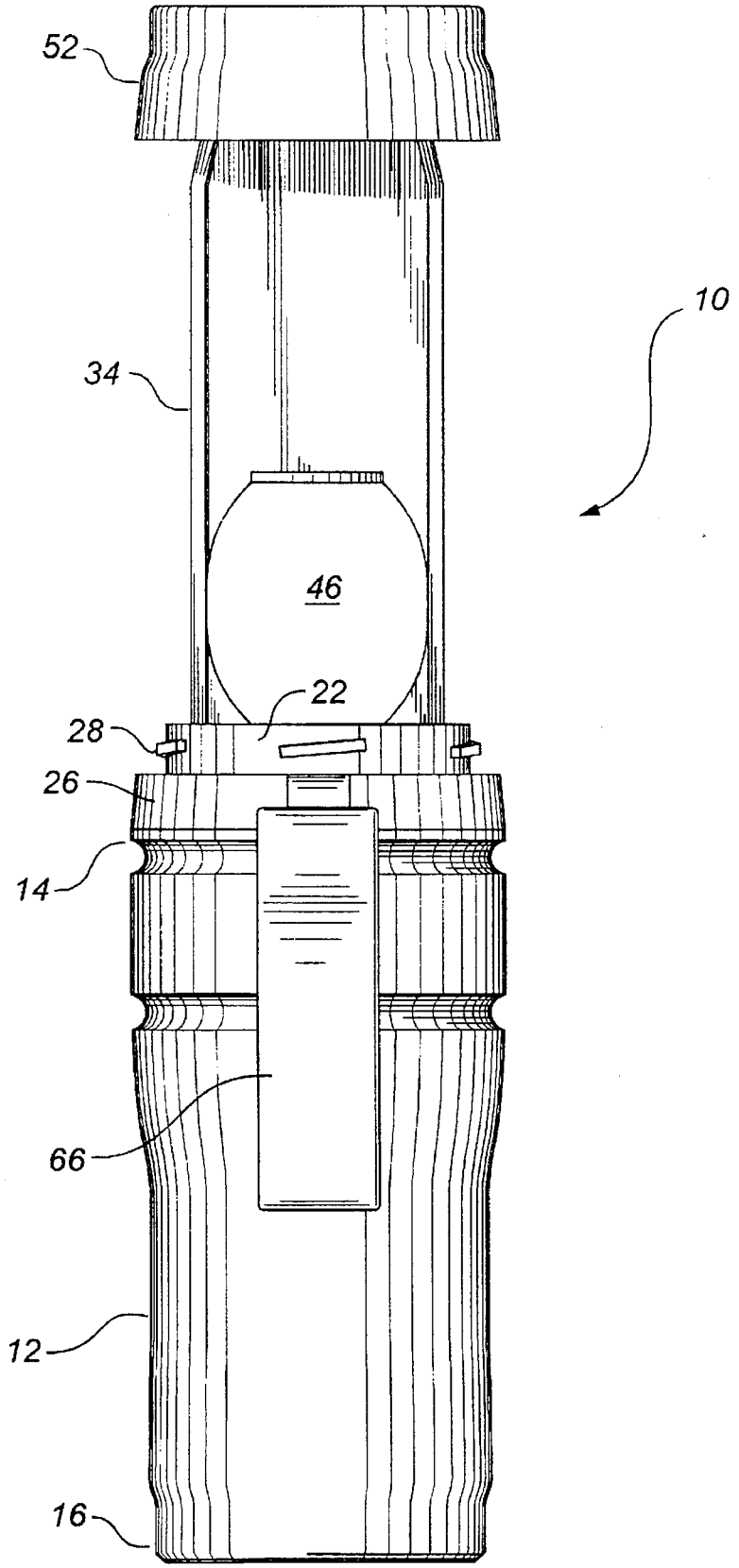
FIG. 2 is a side elevation view of the golf ball washer illustrated in FIG. 1.
Figure 3:
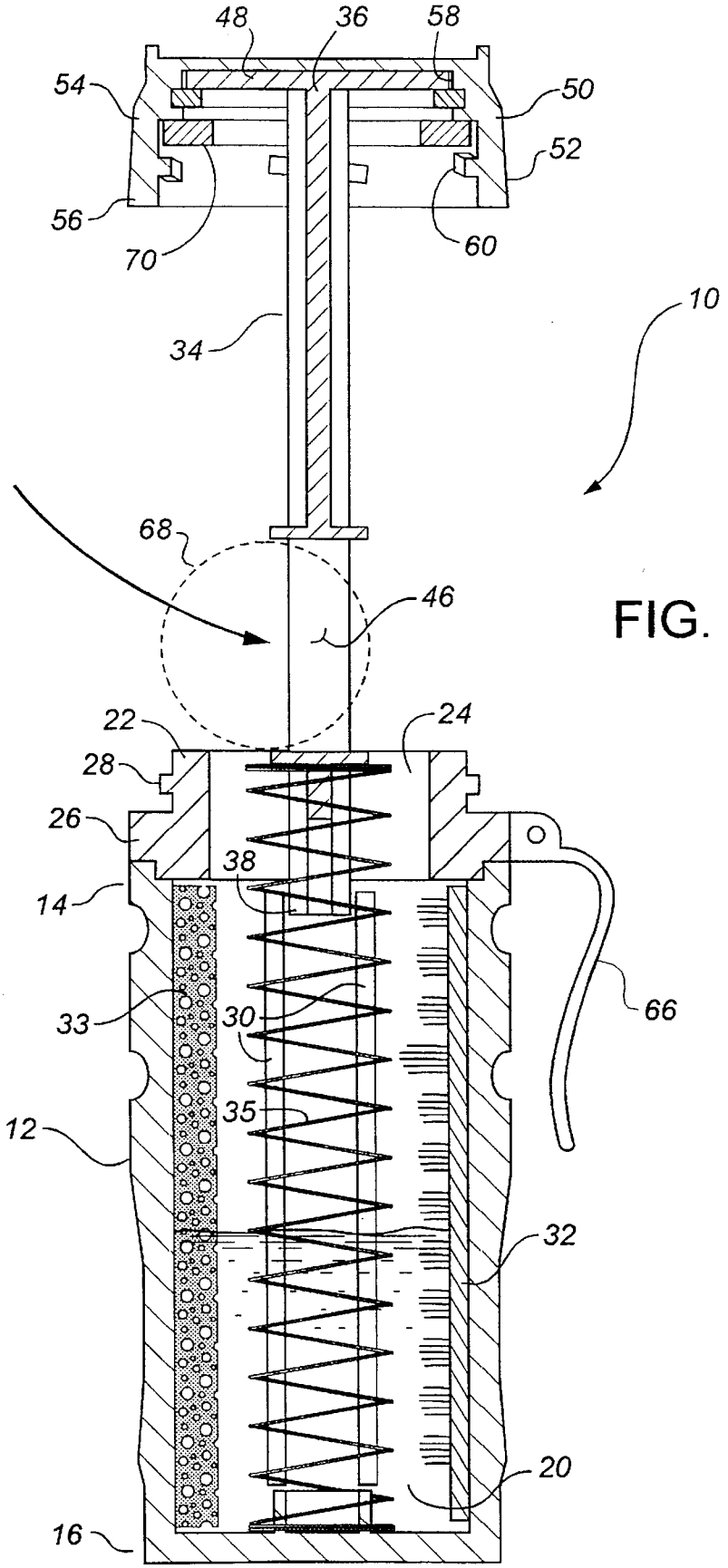
FIG. 3 is a side elevation view in section of the golf ball washer illustrated in FIG. 1 with the plunger positioned in an extended position.
Figure 4:
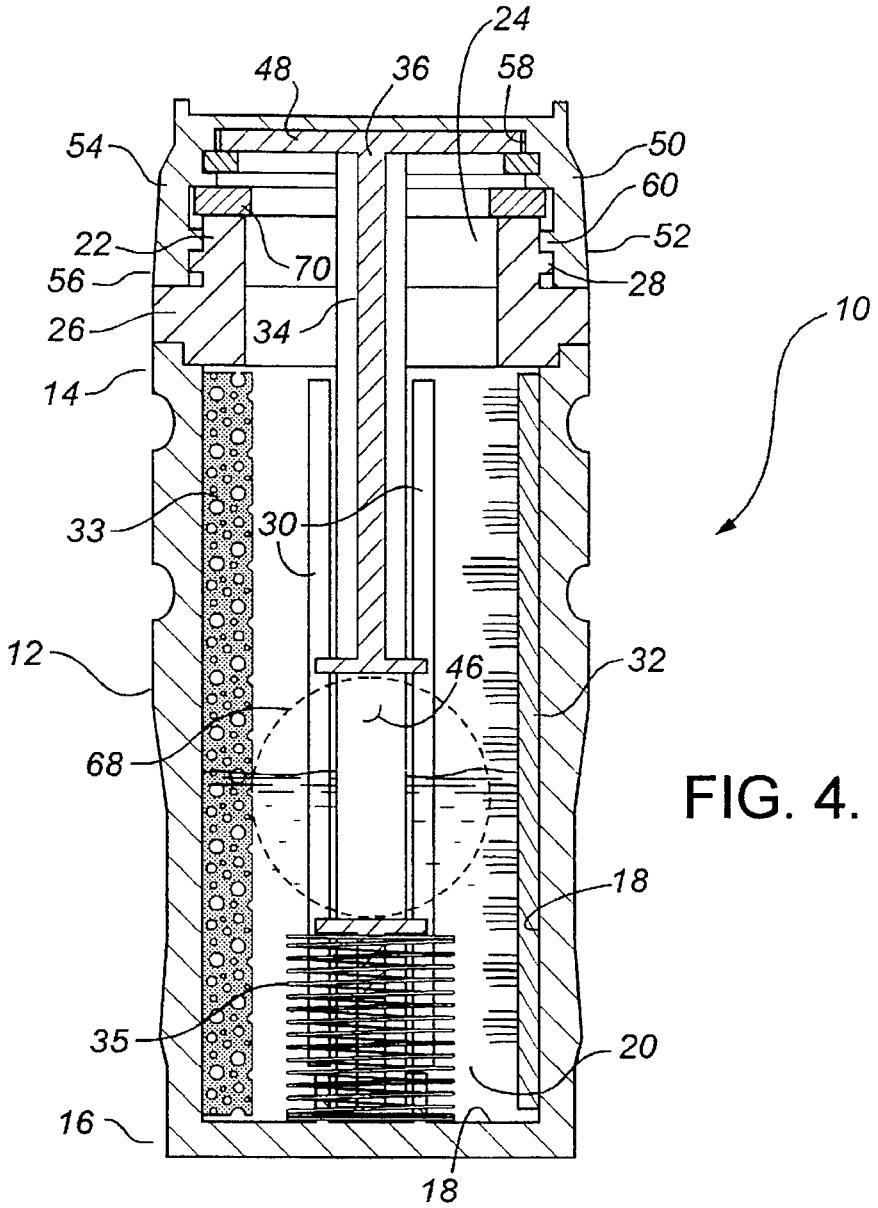
FIG. 4 is a side elevation view in section of the golf ball washer illustrated in FIG. 1 with the plunger positioned in a retracted position.
Figure 5:
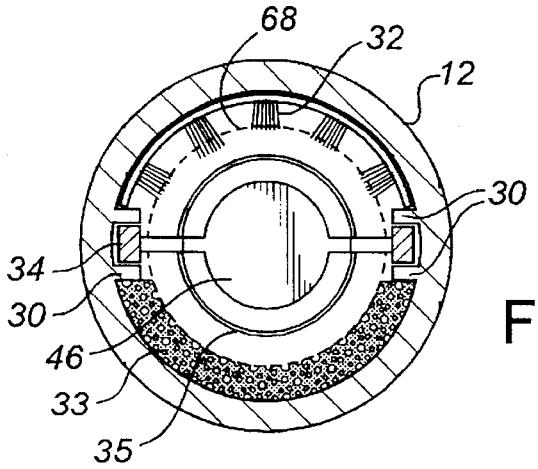
FIG. 5 is a top plan view in section of the golf ball washer illustrated in FIG. 1.
Figure 7:
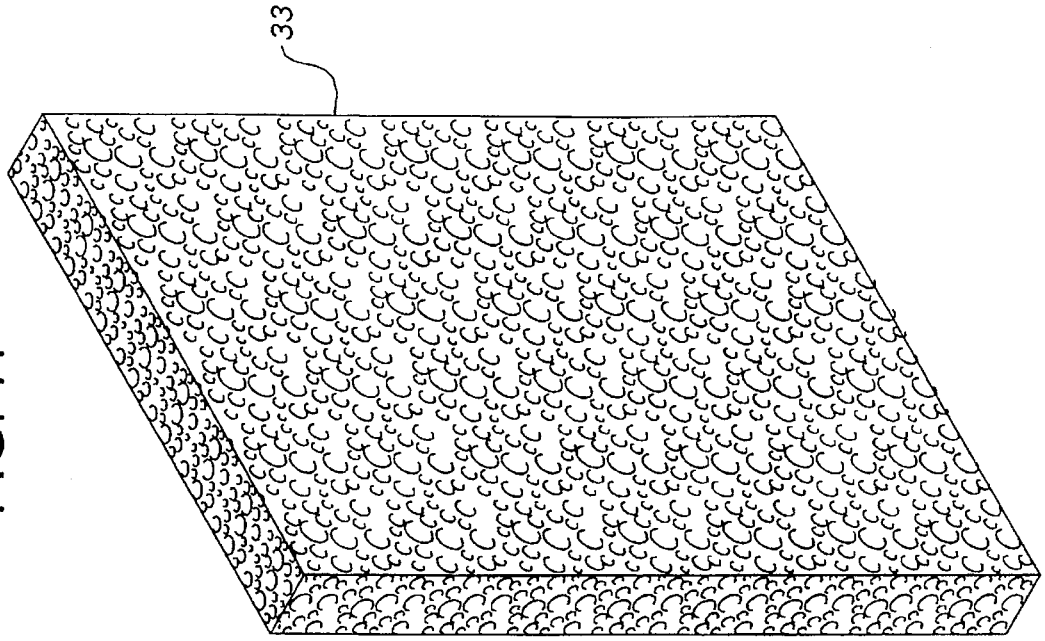
FIG. 7 is a perspective view of a sponge insert illustrated in the golf ball washer illustrated in FIG. 1.
Figure 6:
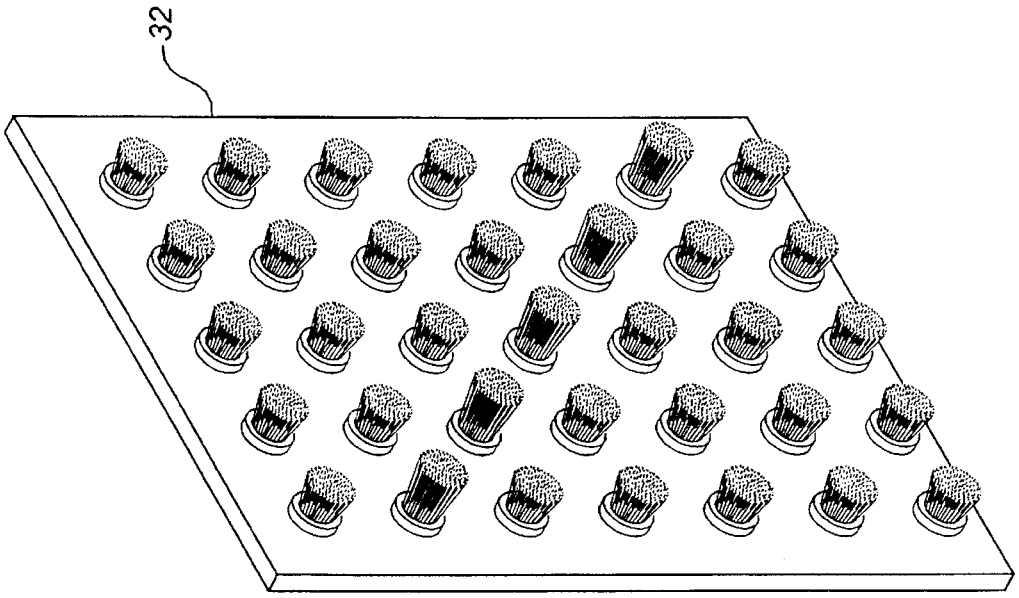
FIG. 6 is a perspective view of a brush insert illustrated in the golf ball washer illustrated in FIG. 1.
Figure 8:
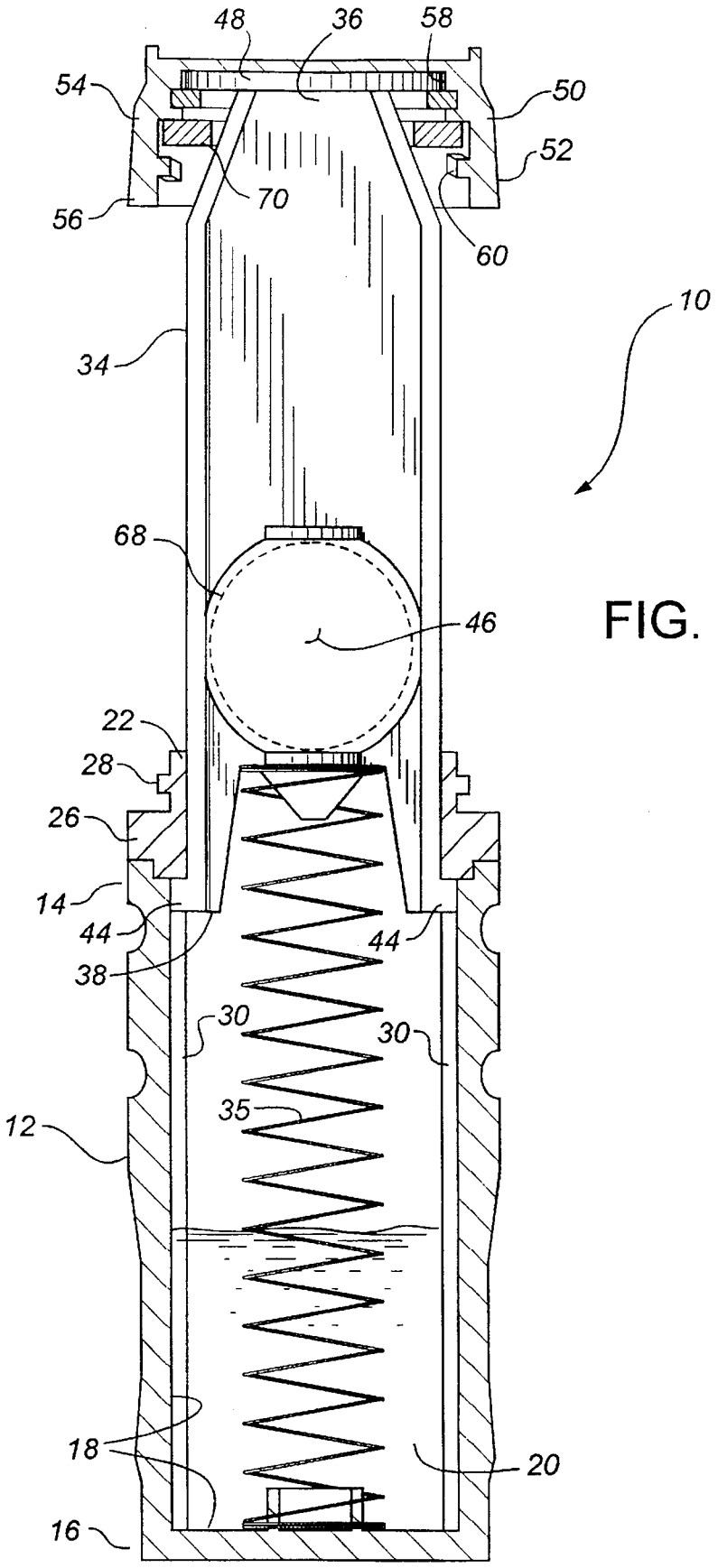
FIG. 8 is a rear elevation view in section of the golf ball washer illustrated in FIG. 1 with the plunger positioned in an extended position.

Referring to FIG. 1, golf ball washer 10 includes a housing 12 having a first end 14, a second end 16. Referring to FIGS. 3 and 4, interior walls 18 of housing 12 define an interior cavity 20. Referring to FIGS. 1 and 3, a cylindrical lip 22 is provided that defines an access opening 24 into interior cavity 20. Referring to FIGS. 3 and 4, for ease of assembly, cylindrical lip 22 is mounted to an annular collar 26 that is permanently affixed to first end 14 of housing 12. Cylindrical lip 22 has exterior threads 28. Referring to FIGS. 3 and 4, a pair of opposed guide tracks 30 are positioned along interior walls 18 of housing 12. Guide tracks 30 extend between first end 14 and second end 16. Abrasive ball cleaning medium 32 and 33 line interior walls 18 of interior cavity 20. The preferred configuration of abrasive ball cleaning medium 32 will hereinafter be further described. Referring to FIGS. 1 through 4, a plunger 34 is provided. Plunger 34 has a first end 36, a second end 38, and opposed sides 40 and 42. Referring to FIG. 8, guide tabs 44 project from opposed sides 40 and 42 adjacent second end 38. When golf ball washer 10 is assembled, second end 38 of plunger 34 is inserted into interior cavity 20 of housing 12 and then annular collar 26 is permanently affixed to first end 14 of housing 12. Guide tabs 44 engaged guide tracks 30 on interior walls 18 of housing 12. Plunger 34 is movable between an extended position as illustrated in FIGS. 1 through 3 and 8, and a retracted position as illustrated in FIG. 4. Referring to FIG. 8, in the extended position first end 36 of plunger 34 telescopically extends from access opening 24 of housing 12. Guide tabs 44 engage annular collar 26 to prevent plunger 34 from being withdrawn from housing 12. Referring to FIG. 2, in the retracted position plunger 34 is confined within housing 12. Referring to FIGS. 3, 4, and 8, a spring 35 is provided that biases plunger 34 into the extended position. Referring to FIGS. 1 through 4, plunger 34 has a golf ball receiving aperture 46 extending therethrough. Golf ball receiving aperture 46 protrudes past access opening 24 when plunger 34 is in the extended position, such that a golf ball 68 can be inserted in golf ball receiving aperture 46. Referring to FIGS. 3 and 4, a transverse disk 48 is positioned at first end 36 of plunger 34, disk 48 is used to rotatably mount a top cap 50 to first end 36 of plunger 34 as will hereinafter be further explained. Top cap 50 has a depending annular skirt 52. Annular skirt 52 has a top end 54 and a bottom end 56. An interior annular groove 58 is positioned in annular skirt 52 adjacent top end 54. Annular skirt 52 also has interior threads 60. Disk 48 which is non-rotatably secured to first end 36 of plunger 34 is received in interior annular groove 58 in top cap 50. Top cap 50 is able to rotate relative to disk 48 as interior annular groove 58 slides along disk 48. Referring to FIGS. 3 through 5, the preferred configuration for abrasive ball cleaning medium 32 and 33 will now be described. Referring to FIGS. 6 and 7, two different types of abrasive ball cleaning medium, identified as 32 and 33 respectively have been used. Abrasive ball cleaning medium 32 is in the form of a rubber substrate upon which is mounted bristles. Abrasive ball cleaning medium 33 is in the form of an abrasive sponge-like material. When inserted into interior cavity 20, medium 32 and 33 assume semi-cylindrical shapes as illustrated in FIG. 5. Abrasive cleaning medium 32 (bristles) and abrasive cleaning medium 33 (sponge) have differing abrasive properties; as a result they act upon ball 68 in differing ways resulting in a rotation of ball 68.

The use and operation of golf ball cleaner 10 will now be described with respect to FIGS. 1 through 8. FIG. 4 illustrates the position in which golf ball cleaner 10 will be kept when not in use. A golfer will carry golf ball cleaning apparatus 10 with him as he plays his round of golf. Golf ball cleaning apparatus can be carried in a pocket of a golf bag, mounted to a golf bag, mounted to a pull-type golf cart or placed in the drink holder of a power golf cart. In the illustrated embodiment housing 12 is shown with a clip 66, by means of which housing 12 may be secured to a golf bag. In order to use golf ball cleaning apparatus 10, the golfer rotates top cap 50. Upon rotation of top cap 50, interior threads 60 on annular skirt 52 become disengaged from exterior threads 28 on cylindrical lip 22 of housing 12. Once interior threads 60 are disengaged from exterior threads 28, plunger 34 can be telescopically extended to the position illustrated in FIG. 3. Although this telescopic extension could be effected by manually pulling upon top cap 50, it is preferred that plunger 34 be moved to full extension by means of spring 35. When in this extended position, golf ball receiving aperture 46 protrudes past access opening 24 enabling golf ball 68 to be inserted. Referring to FIGS. 3 and 4, the cleaning of the golf ball is then effected by pushing against the resistance of spring 35 to move plunger 34 between the extended and retracted positions, thereby drawing the golf ball past abrasive cleaning medium 32 and 33. As previously described, golf ball 68 rotates due to a difference in the friction force applied by abrasive cleaning medium 32 and 33. This enables golf ball cleaner 10 to clean the entire surface of golf ball 68, rather than just selected exposed portions. It will be understood that housing 12 is normally filled with 6 to 8 ounces of a cleaning solution, preferably soapy water or a similar cleaning agent. When the golfer has finished cleaning his golf ball, he releases top cap 50 so that plunger 34 is moved to the extended position by the action of spring 35, and withdraws the golf ball from golf ball receiving aperture 46. Pressure is then exerted upon top cap 50 to return plunger 34 is to the retracted position illustrated in FIG. 4. Once in this retracted position, top cap 50 is rotated until interior threads 60 on annular skirt 52 of top cap 50 mate with exterior threads 28 on cylindrical lip 22 of housing 12. It is well known in the art how to ensure that there is no leakage between housing 12 and top cap 50. For example, an O ring seal 70, similar to those used for sealing sealer jars used in canning, can be added to ensure liquid does not escape.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A golf ball washer, comprising:

a housing having an interior wall defining an interior cavity and a cylindrical lip defining an access opening, the cylindrical lip having exterior threads;

abrasive ball cleaning medium lining the interior wall of the interior cavity;

a plunger disposed within the interior cavity of the housing, the plunger having a first end and a second end, the plunger being movable between an extended position and a retracted position, in the extended position the first end of the plunger telescopically extends from the access opening of the housing, in the retracted position the plunger is confined within the housing, the plunger having a golf ball receiving aperture extending therethrough, the golf ball receiving aperture protruding from the access opening when the plunger is in the extended position, such that a golf ball can be inserted in the golf ball receiving aperture;

a top cap rotatably mounted to the first end of the plunger, the top cap having a depending annular skirt with interior threads, the interior threads on the annular skirt of the top cap mating with the exterior threads on the cylindrical lip of the housing by rotating the top cap relative to the plunger when the plunger is in the retracted position; and guide means between the plunger and the interior wall of the housing, the guide means limiting rotation of the plunger in relation to the housing and guiding the movement of the plunger between the extended position and the retracted position.

2. The golf ball washer as defined in claim 1, wherein a spring is provided in the interior cavity of the housing to bias the plunger toward the extended position and stop means are provided to prevent the second end of the plunger from being withdrawn through the access opening of the housing.

3. The golf ball washer as defined in claim 1, wherein the first end of the plunger is in the form of a disk, the disk being received in an annular groove in the top cap, thereby rotatably mounting the top cap to the first end of the plunger.

4. The golf ball washer as defined in claim 1, wherein the interior wall of the interior cavity has at least two different types of abrasive ball cleaning medium with differing abrasive properties, such that as the plunger is moved between the extended and retracted position past said ball cleaning medium the ball is caused to rotate due to a difference in the friction force applied by the at least two abrasive ball cleaning medium with differing abrasive properties.

5. A golf ball washer, comprising:

a housing having a first end, a second end, an interior wall defining an interior cavity and a cylindrical lip defining an access opening, the cylindrical lip having exterior threads;

a pair of opposed guide tracks on the interior wall of the housing extending between the first end and the second end;

abrasive ball cleaning medium lining the interior wall of the interior cavity;

a plunger disposed within the interior cavity of the housing, the plunger having a first end, a second end, and opposed sides with projecting guide tabs positioned adjacent the second end, the guide tabs on the opposed sides of the plunger engaging the guide tracks on the interior wall of the housing, the plunger being movable between an extended position and a retracted position, in the extended position the first end of the plunger telescopically extends from the access opening of the housing, in the retracted position the plunger is confined within the housing, the plunger having a golf ball receiving aperture extending therethrough, the golf ball receiving aperture protruding from the access opening when the plunger is in the extended position, such that a golf ball can be inserted in the golf ball receiving aperture, a transverse disk being positioned at the first end of the plunger;

stop means being provided in the form of an annular collar at the first end of the housing adjacent the access opening that engages the guide tabs at the second end of the plunger, thereby preventing the second end of the plunger from being withdrawn through the access opening of the housing;

a top cap rotatably mounted to the first end of the plunger, the top cap having a depending annular skirt with an annular groove and interior threads, the disk at the first end of the plunger being received in an annular groove in the top cap, thereby rotatably mounting the top cap to the first end of the plunger, the interior threads on the annular skirt of the top cap mating with the exterior threads on the cylindrical lip of the housing by rotating the top cap relative to the plunger when the plunger is in the retracted position.

6. The golf ball washer as defined in claim 5, wherein the interior wall of the interior cavity has at least two different types of abrasive ball cleaning medium with differing abrasive properties, such that as the plunger is moved between the extended and retracted position past said ball cleaning medium the ball is caused to rotate due to a difference in the friction force applied by the at least two abrasive ball cleaning medium with differing abrasive properties.

* * * * *